United States Patent [19]

Miller

[11] 4,008,638

[45] Feb. 22, 1977

[54] DIE ASSEMBLY FOR FORMING OPENINGS IN WORKPIECES

[75] Inventor: Frederick O. Miller, Saginaw, Mich.

[73] Assignee: Miller Mold Company, Saginaw, Mich.

[22] Filed: Feb. 5, 1976

[21] Appl. No.: 655,499

[52] U.S. Cl. ..... 83/185; 83/191

[51] Int. Cl.[2] ..... B26F 1/02

[58] Field of Search ..... 83/185, 191, 178, 195, 83/54

[56] References Cited

UNITED STATES PATENTS

| | | | |
|---|---|---|---|
| 750,746 | 1/1904 | Woodburn | 83/191 |
| 1,883,079 | 10/1932 | Strickland | 83/185 X |
| 1,920,303 | 8/1933 | Grotnes | 83/191 X |
| 2,320,272 | 5/1943 | Friden | 83/54 |
| 3,259,003 | 7/1966 | Griffin | 83/191 X |

*Primary Examiner*—Frank T. Yost

*Attorney, Agent, or Firm*—Learman & McCulloch

[57] ABSTRACT

A die assembly especially adapted for forming bottom and side openings in a cup-shaped container comprises a base having a cavity therein for the accommodation of the container and a plug movable into and out of the cavity and being of such size as to fit within the container. The plug carries a plurality of springy punches having free ends which project beyond the corresponding end of the plug and which are operable to punch holes in the bottom of the container. The plug carries a floating cam ring provided with means responsive to predetermined movement of the plug into the cavity to cam the punches laterally of the plug and form openings in the side of the container.

16 Claims, 9 Drawing Figures

DIE ASSEMBLY FOR FORMING OPENINGS IN WORKPIECES

The invention disclosed herein relates to a die assembly for forming openings in a workpiece and more particularly to a die construction having punches capable of forming openings in both the bottom and the side of a cup-shaped container.

Flower pots formed of plastics materials are in common usage as substitutes for earthenware pots. It has been found that the growth and longevity of plants contained in plastics pots are improved if the pot is provided with openings in both the bottom and side of the pot.

An object of this invention is to provide a die assembly which enables openings to be formed in both the bottom and the side of a plastics flower pot or other container in one operation.

Another object of the invention is to provide a die assembly of the character referred to which is of economical and durable construction.

Other objects and advantages of the invention will be pointed out specifically or will become apparent from the following description when it is considered in conjunction with the appended claims and the accompanying drawings, in which:

Figure 1:
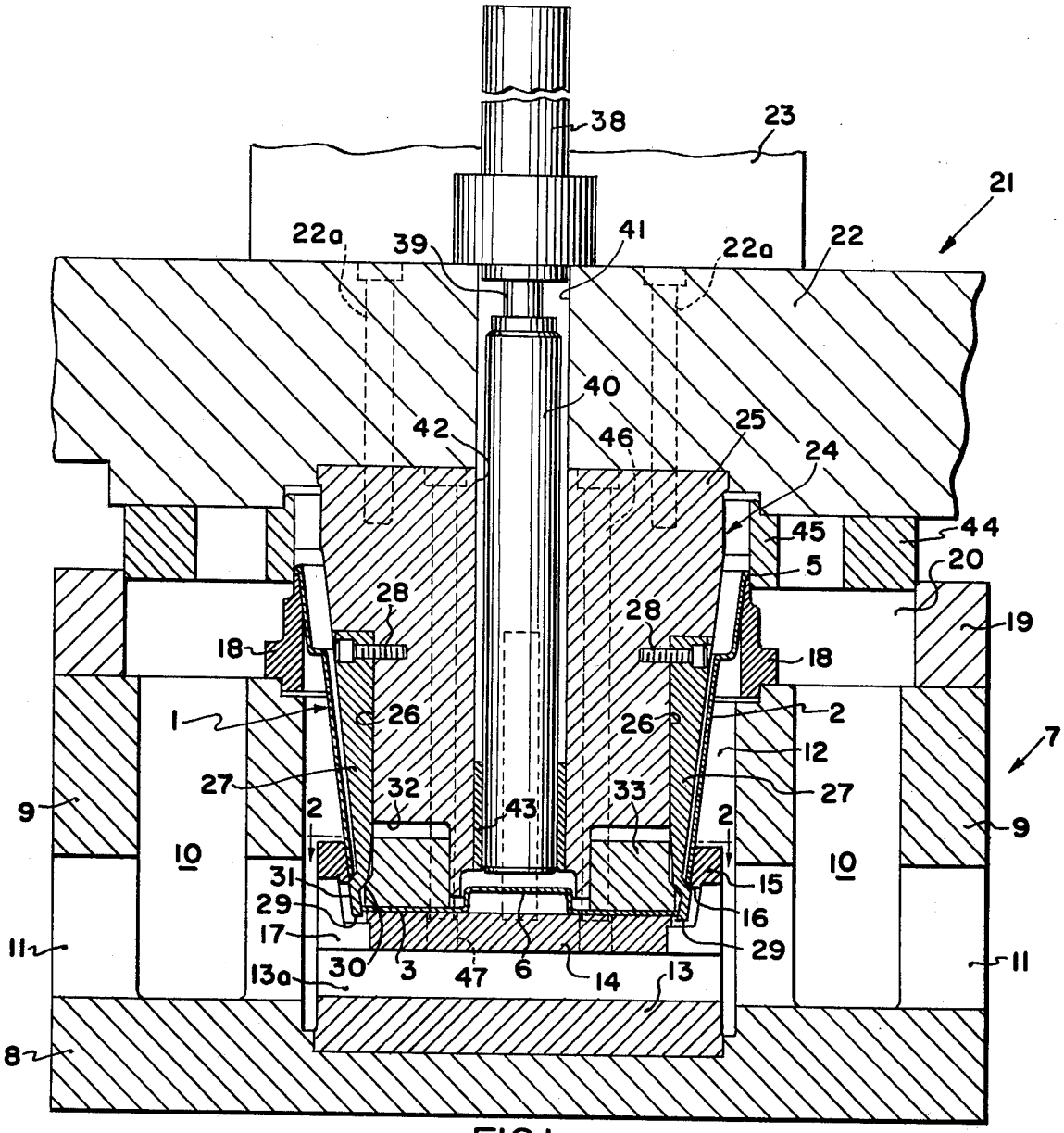
FIG. 1 is a sectional view taken on the line 1—1 of FIG. 2 through a die assembly constructed in accordance with the invention and illustrating the parts of the assembly in the positions they occupy at the conclusion of punching openings in a container.
Figure 2:
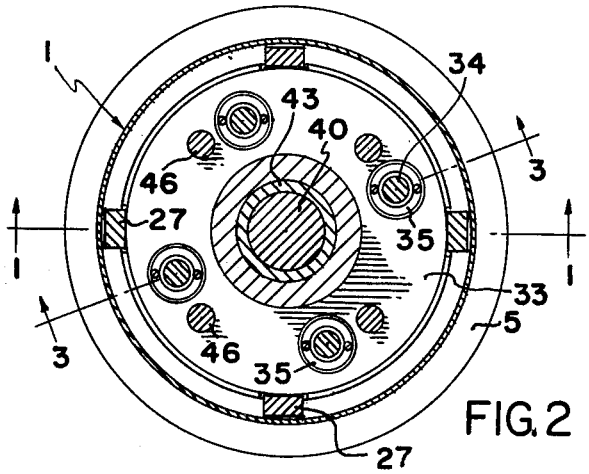
FIG. 2 is a sectional view taken on the line 2—2 of FIG. 1.
Figure 4:
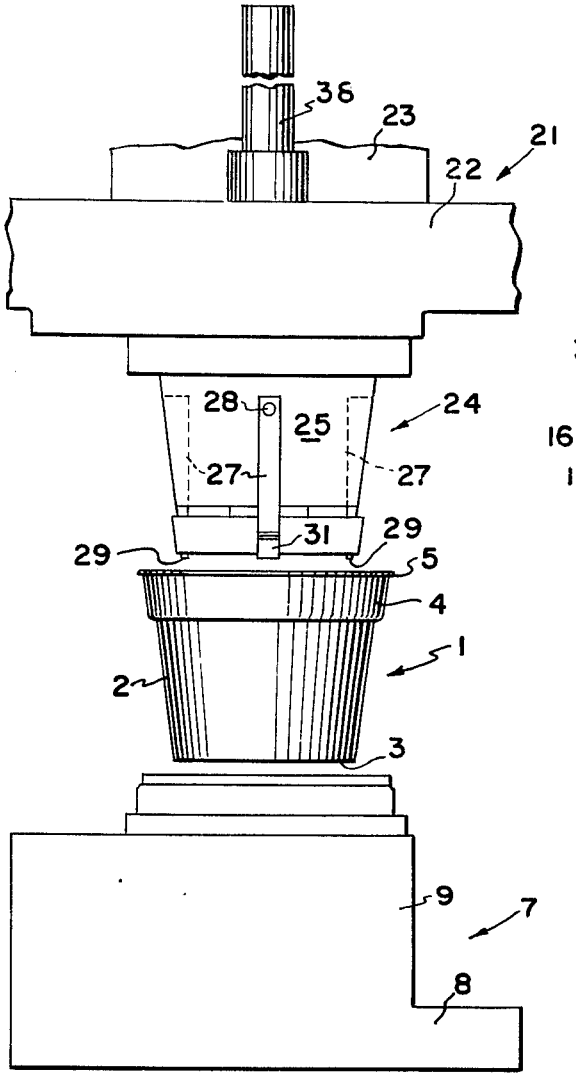
FIG. 4 is an elevational view illustrating the die parts in the positions they occupy when a container is to be introduced to or removed from the assembly.
Figure 3:
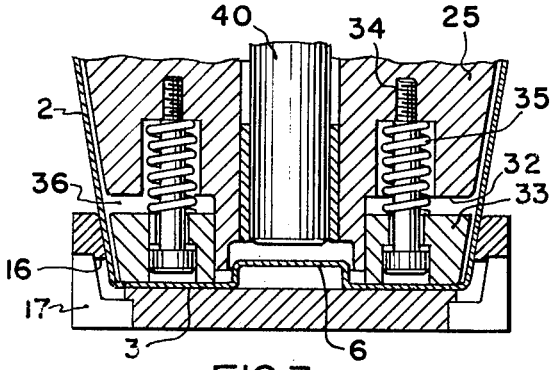
FIG. 3 is an enlarged sectional view taken on the line 3—3 of FIG. 2.
Figure 5:
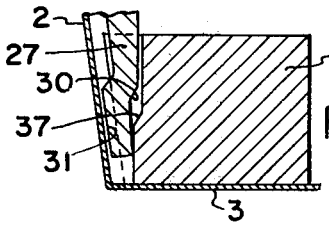
FIG. 5 is an enlarged, sectional view illustrating a punch in the position it occupies just prior to punching an opening in the container.
Figure 6:
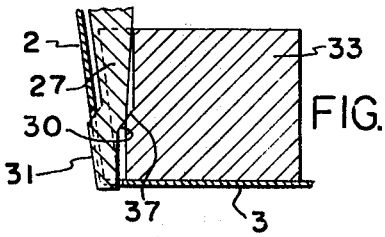
FIG. 6 is a view similar to FIG. 5, but illustrating the position of the punch following the punching of an opening in a container.

A typical container of the kind adapted for use as a flower pot is designated generally by the reference character 1 in FIG. 4 and comprises a generally conical side wall 2 terminating at one end in a bottom wall 3 and at the other end in a stacking flange 4. A flange or bead 5 surrounds the open end of the container. In some instances the bottom 3 may have a centrally located, upstanding boss 6.

A die assembly constructed according to the embodiment illustrated in FIGS. 1–6 comprises a base 7 having a bottom 8 provided with an upstanding annular wall 9. The wall 9 has vertical and horizontal passages 10 and 11, respectively, therein and defines a central cavity 12. At the base of the cavity is fixed a spacing plate 13 having a horizontal passage 13*a* therein and on which is bolted or otherwise secured a die disc 14 having an upstanding, peripheral flange 15. The flange 15 has a diameter and taper corresponding to the diameter and taper of the container wall 2 adjacent its closed end. The lower, radially inner edge of the flange 15 overhangs the disc 14 to form a cutting edge 16 (FIG. 3) for a purpose presently to be explained.

At spaced intervals around the periphery of the disc 14 are radially extending passageways 17, the purpose of which hereinafter will be explained. The diameter of the disc 14 is less than that of the container bottom 3 so that, when the container is accommodated in the cavity 12 and seats upon the disc 14, the peripheral edge of the bottom 3 extends radially beyond the disc. The purpose of this construction also will be explained subsequently.

Fixed to the upper end of the wall 9 is a trim ring 18 which is adapted to engage and support the flange 5 of the container. Radially outwardly of the trim ring 18 is a guide ring 19 that also is fixed to the wall 9. Between the rings 18 and 19 is an annular space 20.

The die assembly also includes a reciprocable platen 21 having a plate 22 fixed to upstanding members 23 by means of which the platen may be reciprocated vertically. Secured to the platen 22 by bolts 22*a* (FIG. 1) or the like is a plug 24 having a downwardly tapering body 25, the taper of which corresponds to that of the wall 2 of the container 1. The cross-sectional size of the plug is such as to enable it not only to be accommodated in the cavity 12, but also to fit within the container 1 when the latter is in the cavity.

At circumferentially spaced intervals the plug body 25 is provided with axially extending recesses or notches 26. Fitted into each recess is an elongate, downwardly tapering punch 27 formed of resilient material such as spring steel. Each punch 27 is secured at its upper end only to the plug body 25 by means of a bolt 28. The lower end of each punch 27 terminates in a cutting edge 29 and is of such length as to project beyond the lower end of the plug body 25.

Adjacent its free end, each punch is relieved on its inner side to form an inclined deflecting or cam surface 30. In addition, each punch is provided adjacent its free end with an outwardly directed cutting surface 31.

At the lower end of the plug body 25 is a circumferential recess 32 in which is slidably accommodated a floating, annular cam ring 33. The ring is coupled to the plug body 25 by a plurality of headed bolts 34 each of which is encircled by a spring 35 which acts on the cam ring 33 so as normally to provide a space 36 between it and the body 25, but which permits relative vertical movement of the plug and the cam ring. At circumferentially spaced intervals corresponding to the spacing of the punches 27, the cam ring 33 is provided with outwardly and downwardly inclined defelectors or cam surfaces 37 which are complementary to and lie in the path of downward movement of the deflecting or cam surfaces 30 of the punches 27.

Fixed to the plate 22 is an air cylinder 38 having a reciprocable piston 39 fixed to an ejector rod 40 which is reciprocably accommodated in a bore 41 formed in the platen. The ejector rod 40 also extends through a bore 42 formed in the plug body 25 and at its lower end extends through a bushing 43. The rod 40 is reciprocable in response to operation of the air cylinder 38 so as to slide axially of the plug body 25 to strip a container 1 from the plug.

To the lower surface of the plate 22 is bolted or otherwise fixed a guide ring 44 which cooperates with the guide ring 19 and a cutting ring 45 which cooperates with the trim ring 18 to trim the bead 5 of the container 1.

If desired, the plug body 25 also may be provided with a plurality of circumferentially spaced, axially extending punches 46. The punches are located inwardly of the periphery of the plug body 25 and are aligned with openings 47 in the disc 14.

To condition the apparatus for operation, the platen 21, including the plug 24, is raised to the position shown in FIG. 4 so as to provide sufficient clearance to enable a container 1 to be introduced to the cavity 12. Upon introduction of the container to the cavity 12, the bottom 3 of the container seats upon the disc 14 and is supported at the level thereof, the lower end of the wall 2 fits snugly against the tapered surface of the flange 15, and the bead 5 rests upon the trim ring 18.

In the raised position of the platen 21, the cam ring 33 occupies its lowermost position. That is, the space 32 has its maximum height. The axial length of the punches 27, however, is such that, even when the cam ring 33 occupies its lowest position relative to the plug 25, the cutting edges at the free ends of the punches project below the ring 33, as is shown in FIG. 4.

Following insertion of the container into the cavity 12, the platen 21 is lowered, thereby causing the plug 22 to enter the cavity inside the container 1. As the plug 24 moves downwardly, the punches 27 and 46 engage the bottom 3 of the container 1 just prior to the time the cam ring 33 seats on the container bottom. The punches 46 will form openings in the bottom 3 between the side wall 2 and the boss 6, whereas the cutting edges 29 of the punches 27 will form openings in the bottom adjacent the juncture of the latter with the wall 2. Those portions of the bottom cut from the latter by the punches 46 will fall through the openings 27 into the passage 13*a*.

Figure 9:
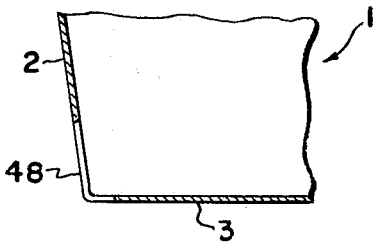
FIG. 9 is a fragmentary, sectional view of a container having an opening formed by apparatus according to the invention.

As the plug continues to move downwardly, movement of the cam ring 33 will be interrupted by its engagement with the bottom 3, and relative movement occurs between the plug body 25 and the ring 33 due to the space 32. Since the cam surfaces 37 of the ring 33 lie in the path of downward movement of the cam surfaces 30 of the punches 27, the cam surfaces will engage one another whereupon the free ends of the punches will be deflected transversely outwardly to cause the cutting edges 16 and the cutting surfaces 31 to cut the side wall 2 of the container. Such transverse movement is possible because the periphery of the disc 14 is radially inwardly of the punches 27, but does not occur, however, until the cutting edges 29 have passed beyond the level of the bottom 3. Each punch 27 thus forms an L-shaped opening 48 (FIG. 9) in the container 1, a portion of the opening being in the container bottom 3 and the other portion of the opening being in the wall 2.

As the plug 25 approaches its lowermost position, the cutting ring 45 and the trim ring 18 will act on the rim 5 of the container to trim the rim. Material severed from the rim will pass through the opening 20 into the openings 10 and 11. Material severed from the container to form the openings 48 will pass through the openings 17 into the passages 10 and 11 for discharge.

Following the punching operation, the platen 21 is elevated. During the initial elevation of the platen, the springs 35 maintain the cam ring 33 snugly against the container bottom 3, but the plug body 25 moves upwardly with the platen so as to effect disengagement between the cam surfaces 30 and 37. As the cam surfaces disengage one another, the inherent springiness of the material from which the punches 27 are made restores the latter to their radially withdrawn or recessed positions, thereby permitting removal of the container 1 from the plug. Such removal of the container is assured by operation of the air cylinder 38 to extend the ejector rod 40 into engagement with the container bottom.

Figure 7:
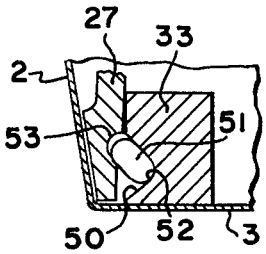
FIGS. 7 and 8 are views similar to FIGS. 5 and 6, respectively, but illustrating a modified form of the invention.
Figure 8:
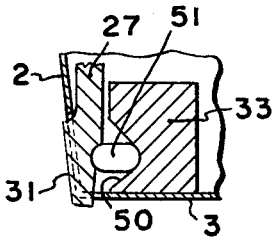

The embodiment illustrated in FIGS. 7 and 8 is similar to that just described, but differs from the latter in the means for deflecting the punches 27 transversely outwardly. In the modified embodiment the cam ring 33 has a V-shaped notch 50 adjacent each punch 27 in which is accommodated a cam 51 having rounded ends. One end of the cam seats on a correspondingly rounded surface 52 at the base of the notch and its other end is accommodated in a correspondingly rounded recess 53 formed in the punch 27. The cam 51 is trapped between the punch 27 and the ring 33, but is free to rock in a vertical plane.

When the platen 21 and its associated parts are in their initial or elevated positions, the punches 27, the ring 33, and the cams 51 occupy the positions shown in FIG. 7, wherein the inner surface of each punch lies snugly against the outer surface of the ring 33. As is shown in FIG. 7, the length of the cam 51 is less than the distance between the rounded surfaces 52 and 53. As a consequence, the punch 27 can move downwardly relatively to the ring 33 before the cam 51 is caused to rock. The difference between the length of the cam 51 and the distance between the rounded surfaces should be such to permit the end 29 of the punch to sever the bottom wall 3 prior to outward deflection of the punch.

When the punches 27 have moved downwardly a distance sufficient to cause the bottom wall 3 to be severed, further downward movement of the punches will cause the cams 51 to be rocked counterclockwise, as viewed in FIGS. 7 and 8, thereby deflecting or camming the punches outwardly (see FIG. 8) and effecting severing of the side wall 2 by means of the cutting surfaces 31 to produce the L-shaped openings 48. Upward or return movement of the platen 21 will effect restoration of the punches to their retracted positions, as shown in FIG. 7, due to the springiness of the material from which the punches are made.

The disclosed embodiments are representative of presently preferred forms of the invention, but are intended to be illustrative rather than definitive thereof. The invention is defined in the claims.

I claim:

1. A die assembly for forming a bottom and side opening in a cup-shaped container, said assembly comprising a base having a cavity for supporting said container with its bottom at a predetermined level; a plug of such size as to fit within said container; means supporting said plug for movement in a direction into said cavity; a punch carried by said plug for movement with the latter in said direction beyond said level and for movement relative to said plug transversely of said direction; and deflecting means supported in the path of movement of said punch in said direction and responsive to movement of said punch in said direction beyond said level to deflect said punch transversely of said direction.

2. An assembly according to claim 1 wherein said punch has a free end protruding beyond the corresponding end of said plug.

3. An assembly according to claim 1 wherein said deflecting means comprises a cam.

4. An assembly according to claim 1 wherein said punch comprises an elongate springy member having a free end, and including means securing said member adjacent its opposite end to said plug whereby the springiness of said member enables its free end to be deflected.

5. An assembly according to claim 1 wherein said deflecting means comprises a cam and means mounting said cam on said plug for movement both with and relative to the latter.

6. An assembly according to claim 5 wherein said punch has a cam surface engageable with said cam.

7. An assembly according to claim 5 wherein said deflecting means comprises a rockable cam.

8. An assembly according to claim 1 including at least one additional punch carried by said plug for forming an additional opening in said container.

9. An assembly according to claim 7 wherein said additional punch extends axially of said plug inwardly of its periphery.

10. A die assembly for forming a bottom and side opening in a cup-shaped container, said assembly comprising a base having a cavity of such size as to accommodate said container; a plug of such size as to fit within said container; means for moving said plug in a direction toward said base and into said cavity; at least one punch; means securing said punch to said plug for movement with the latter in said direction and for movement transversely to said direction; cam means; and means mounting said cam means on said plug in the path of movement of said punch in said direction, said cam means being responsive to predetermined movement of said plug into said cavity to deflect said punch transversely of said direction as said plug continues to move in said direction.

11. An assembly according to claim 10 wherein said cam means is of such size as to fit within said container and engage its bottom.

12. An assembly according to claim 11 wherein said punch has a free end projecting beyond the corresponding end of said plug.

13. An assembly according to claim 12 wherein said cam means and said free end of said punch have engageable complementary cam surfaces.

14. An assembly according to claim 12 wherein said cam means comprises an elongate, rockable member.

15. An assembly according to claim 12 including a plurality of said punches spaced about said plug.

16. An assembly according to claim 15 including a plurality of said cam means corresponding to the number of said punches.

* * * * *